US008368627B2

(12) United States Patent
Chen et al.

(10) Patent No.: US 8,368,627 B2
(45) Date of Patent: Feb. 5, 2013

(54) ADAPTIVE FEEDBACK CONTROL METHOD OF FSC DISPLAY

(75) Inventors: Chun-Ho Chen, Changhua County (TW); Yi-Pai Huang, Chiayi (TW); Ke-Horng Chen, Taipei County (TW); Fang-Cheng Lin, Taichung County (TW); Han-Ping Shieh, Hsinchu (TW); Chi-Chung Tsai, Kinmen County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1016 days.

(21) Appl. No.: 12/391,804

(22) Filed: Feb. 24, 2009

(65) Prior Publication Data

US 2010/0214201 A1 Aug. 26, 2010

(51) Int. Cl.
*G09G 3/36* (2006.01)

(52) U.S. Cl. ..... 345/88; 345/87; 345/89; 345/690

(58) Field of Classification Search ..... 345/87, 345/88; 382/233
See application file for complete search history.

(56) References Cited

U.S. PATENT DOCUMENTS 5,337,068 A 8/1994 Stewart et al.
6,570,554 B1 5/2003 Makino et al.
6,714,681 B1 * 3/2004 Nakamura ..... 382/233
6,831,621 B2 * 12/2004 Nakano ..... 345/87
6,911,963 B2 * 6/2005 Baba et al. ..... 345/88
7,057,668 B2 6/2006 Herrmann

OTHER PUBLICATIONS

Jongseo Lee, Taejong Jun, Jooyoung Lee, Jungsuk Han, Jun H. Souk, Noble Measurement Method for Color Breakup Artifact in FPDs, IMID/ IDMC '06 Digest, p. 92-97. 5-3/ J. Lee.

* cited by examiner

*Primary Examiner* — Quan-Zhen Wang
*Assistant Examiner* — Troy Dalrymple
(74) *Attorney, Agent, or Firm* — WPAT PC; Justin King

(57) ABSTRACT

An adaptive feedback control method of a field sequential color display includes: a rearrangement step of converting gray-scale values of a three primary color field of an input image into gray-scale values of a new three primary color field and a dominated color field; a sampling step of performing a pixel sampling on a resolution of the input image in a sampling interval; a feedback control step of performing a pixel by pixel sum operation for each separated color on a color break-up value and a color value of the input image in a Lu'v' color space to obtain a color difference sum, and performing a feedback control at a bit precision on the color difference sum; and a liquid crystal/backlight synchronization step of synchronizing a liquid crystal signal and a backlight grayscale value of the input image according to the minimum color difference sum.

8 Claims, 9 Drawing Sheets

ADAPTIVE FEEDBACK CONTROL METHOD OF FSC DISPLAY

BACKGROUND OF THE INVENTION

1. Field of Invention

The present invention relates to an image displaying technique, and more particularly to an adaptive feedback control method, suitable for performing an adjustment timely according to a frame content to achieve a backlight color field with a minimum image color difference, thereby alleviating a color break-up (CBU) phenomenon of a field sequential color (FSC) display.

2. Related Art

A conventional liquid crystal display (LCD) utilizes a color filter to achieve full-color effects, but the luminous efficiency thereof is not desirable. Based on a fast-response liquid crystal panel, such as an optically compensated bend (OCB) mode, and a backlight source, such as a high-efficient light-emitting diode (LED), developed in recent years, an LCD with a field sequential color (FSC) mechanism has been achieved. Particularly, the speed for sequentially displaying main color fields of red, blue, and green is higher than a time resolution of a response of human eyes, so that the full-color effects can be achieved without requiring any color filter. Through combining the backlight of LEDs with the liquid crystal panel in the OCB mode, an FSC-LCD is expected to become a color LCD with a high luminous efficiency, low power consumption, and low material cost.

However, generally, the critical problem of a conventional FSC-LCD lies in a color break-up (CBU) problem. The CBU problem is caused by a relative movement between an object in an image and eyes of an observer, that is, during a saccade interval of human eyes, a signal from human eyes to human brains is suppressed due to a saccadic suppression. Referring to FIG. 1, a CBU image simulated with an RGB FSC is shown. In the circled position, the CBU phenomenon can be recognized, and as a result, the definition of the whole image is deteriorated. FIG. 2 is a schematic view of a color image displaying method in a conventional FSC. Referring to FIG. 2, under a circumstance that an observation spot is moved as time elapsed, the CBU phenomenon can be found through a pattern displayed in an FSC color displaying manner. In the FSC color displaying manner, an image is displayed in a time sequence, and a color sequence thereof is "RGB RGB RGB . . . ", in which R represents a red sub-frame, G represents a green sub-frame, and B represents a blue sub-frame. Taking a white image W10 as an example, when it requires to display a white image, in the white image W10 as seen from the observation spot, a combination of B, B, and G is presented on one edge W11 (on the left of FIG. 2) of the white image W10 and a combination of R, R, and G is presented on the other edge W12 (on the right of FIG. 2), which is the so-called CBU phenomenon.

Considering the FSC applications, U.S. Pat. No. 5,337,068 has disclosed a FSC display system and a method for forming an image, in which a liquid crystal device is used together with backlights in three colors of red, blue, and green. The three backlights emit lights respectively, and then the liquid crystal device simultaneously adjusts the light flux respectively, thereby constituting sub frames in three different colors, and finally, the red, blue, and green sub frames are formed into a color frame. As for the conventional FSC system architecture and the method for forming an image, the CBU phenomenon is rather obvious, which can be easily recognized by the observers.

U.S. Pat. No. 6,570,554 has disclosed an LCD, in which sub color fields of three consecutive frames are regularly converted to solve the CBU problem of the conventional FSC-LCD. When the observer tracks an animation object with his/her eyes at the same speed, an integral result of the three consecutive frames is left on the retina of human eyes without generating the CBU phenomenon. Unfortunately, in this method, when the frequency of the green color field is lower than 50 Hz, the human eyes can perceive a flicker phenomenon, and as a result, the frame quality is deteriorated.

Furthermore, U.S. Pat. No. 7,057,668 has disclosed an image signal processing method for alleviating the CBU phenomenon of the FSC. In a display with red, blue, and green LEDs, or an additional white LED, serving as the backlights, when an image signal is input, it is converted into an YCrCb color system. When a CBU phenomenon of the display content is fairly slight, an image frame is displayed in an FSC manner. When the CBU phenomenon of the display content is rather severe, the backlights are adjusted into all white lights, that is, the red, blue, and green LEDs are all turned on to emit lights, or merely the white LED is turned on to emit lights, thereby suppressing the CBU phenomenon. However, when the backlights are all turned on, color filters are still required for achieving the full-color effects of the image.

Furthermore, Jongseo Lee et al. has published an article entitled "Noble Measurement Method for Color Breakup Artifact in FPDs" in IMID/IDMC'06, in which CIE LUV color coordinates are utilized to analyze the CBU phenomenon, and it is defined that a color difference ($\Delta E$) in the coordinates is a factor for quantification of the CBU. However, in the published document, other novel method for improving the CBU phenomenon is not mentioned.

In terms of alleviating the CBU problem, U.S. Pat. No. 6,911,963 has disclosed an FSC display method for reducing the CBU phenomenon, in which a time sequence of brightness information of an input image information with all the display colors is displayed. In order to display the input image information, that is, synchronously changing the display color and the brightness information, one color image is displayed in at least four sub field intervals in one frame interval, and one picture signal in at least one sub field interval is a non-primary color picture signal, which is generated by at least two primary color signals in the input picture signal carrying primary color signals. The processing manner includes converting the grayscale rgb of the image into a statistical graph of tristimulus values XYZs in a CIE1931XYZ color system, and then converting the statistical graph into corresponding tristimulus values XYZs of backlight colors, thereby determining the color of the additional sub field.

When the above methods are used, the following three conditions must be preset, including:

(1) the CBU easily occurs at a high-frequency portion of a high-brightness (Y value) signal level;

(2) the CBU easily occurs when a frequency of an X value is larger than that of a Z value; and (3) the CBU easily occurs at a portion with a high Z value, that is, both the X value and the Y value are lower.

Therefore, the color selected from each signal level satisfying the above conditions (1)-(3) is the color of the additional fourth sub field. However, in order to acquire the color of the fourth sub field, the statistics of the image must be analyzed first, which is not only time consuming, but also increases the calculation capacity.

In view of the above problems, the inventor has proposed an adaptive feedback control method of an FSC-LCD, so as to overcome the defects of the prior art.

SUMMARY OF THE INVENTION

Accordingly, the present invention is directed to a technique for synchronously updating both liquid crystal and backlight grayscale information according to an input image content, so that the color brightness originally distributed in various color fields is concentrated in a single color field, which significantly reduces a color difference sum as compared with each pixel of an input frame, thus effectively suppressing the CBU phenomenon.

In order to achieve the above objectives, the present invention provides an adaptive feedback control method, which includes: a rearrangement step of converting gray-scale values of a three primary color field of an input image into gray-scale values of a new three primary color field and a dominated color field (D-field); a sampling step of performing a pixel sampling on a resolution of the input image in a sampling interval; a feedback control step of performing a pixel by pixel sum operation for each separated color on a CBU color value and a color value of the input image in a Lu'v' color space to obtain a color difference sum, and performing a feedback control at a bit precision on the color difference sum, thereby obtaining a minimum color difference sum; and a liquid crystal/backlight synchronization step of synchronizing a liquid crystal signal (LC signal) and a backlight information of the input image according to the minimum color difference sum.

Preferably, the sampling interval is a 2×4 pixel by pixel interval.

Preferably, the color difference sum $\Delta E_{sum}$ is represented as follows:

$$\Delta E_{sum} = \sum_{total-pixel} \sqrt{(L_{CBU} - L_0)^2 + (u'_{CBU} - u'_0)^2 + (v'_{CBU} - v'_o)^2}\ ;$$

in which $Lu'v'_{CBU}$ and $Lu'v'_0$ respectively represent the CBU color value and the color value of the input image in the Lu'v' color space.

Preferably, the bit precision is 3-bit precision.

Preferably, the new gray-scale values r', g', b', and d in the rearrangement step are represented in the following equations:

$$r' = T^{-1}(T(r) - T(d) \times BL_r);$$

$$g' = T^{-1}(T(g) - T(d) \times BL_g);$$

$$b' = T^{-1}(T(b) - T(d) \times BL_b);$$

and $$d = T^{-1}\left(\min\left(\frac{T(r)}{BL_r}, \frac{T(g)}{BL_g}, \frac{T(b)}{BL_b}, 1\right)\right);$$

in which T(i) represents a transfer function from a gray-scale value i to a transmittance of liquid crystal (LC), and $T^{-1}$ is an inverse function thereof.

Preferably, the interval generates 8 groups of CBU color difference sums (CBU–$\Delta E_{sum}$).

BRIEF DESCRIPTION OF THE DRAWINGS

The present invention will become more fully understood from the detailed description given herein below for illustration only, and thus are not limitative of the present invention, and wherein:

FIG. 7(*b*) shows an image generated in a white display mode when a conventional D-field provides the highest RGB value (a WRGB color field).

FIG. 7(*c*) shows an image generated when a color difference between the CBU and the original image are summed up (a DRGB color field) according to the present invention.

FIG. 8(*b*) is a schematic view of ultimate backlight values obtained through an approximation with a precision at 3 bits.

DETAILED DESCRIPTION OF THE INVENTION

Figure 1:
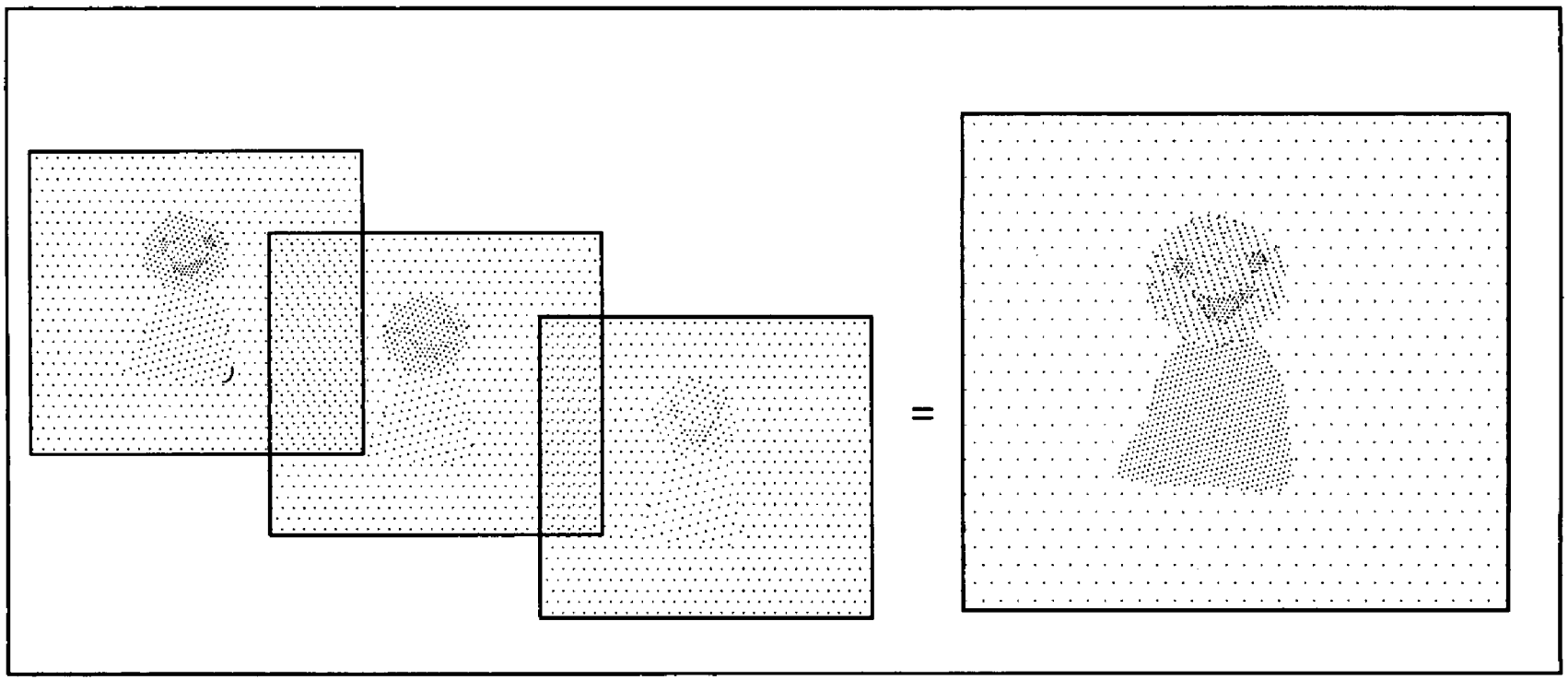
FIG. 1 (prior art)
FIG. 1 shows a CBU image simulated with an RGB FSC.
Figure 2:
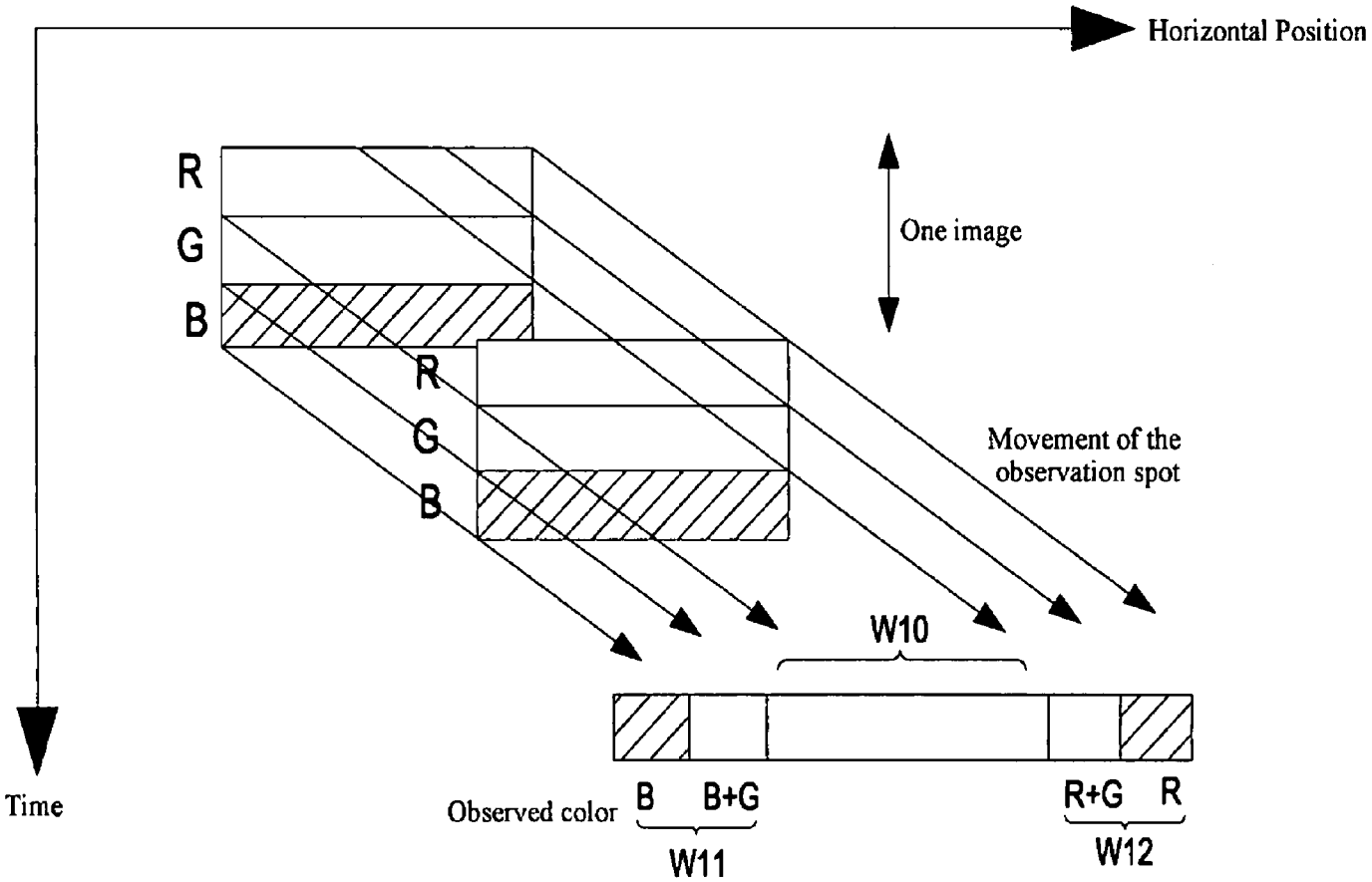
FIG. 2 (prior art)
FIG. 2 is a schematic view of a color image displaying method in a conventional FSC.

Although several preferred embodiments are cited in the present invention for illustration, the accompanying drawings and the following specific implementations are merely taken as preferred embodiments of the present invention. It should be noted that, the following specific implementations are merely examples of the present invention, but not intended to restrict the present invention in the drawings and specific implementations.

Hereinafter, embodiments of a method of the present invention are specifically described.

Figure 3:
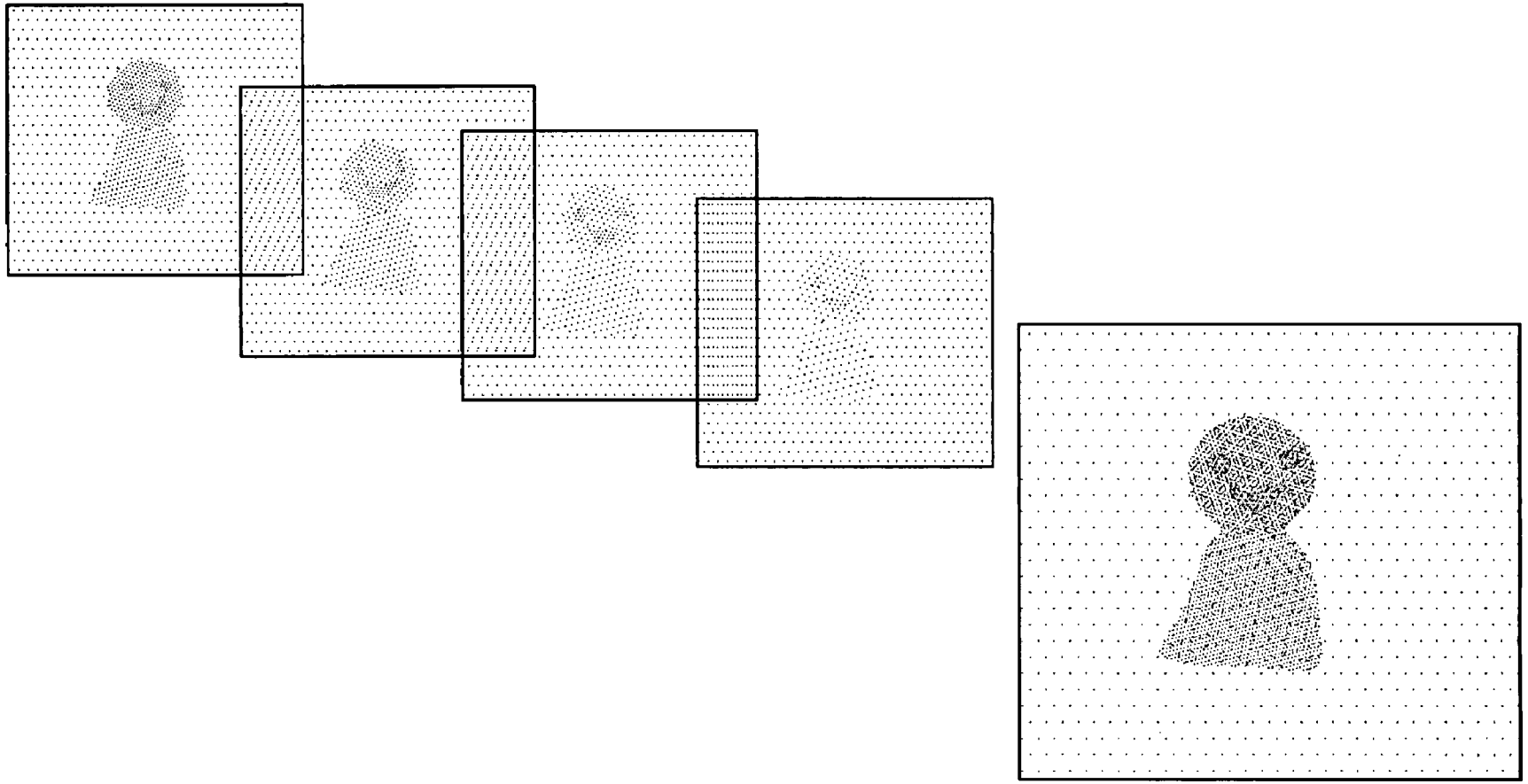
FIG. 3 shows a CBU image simulated through an FSC of a D-field according to the present invention.

In order to particularly suppress the CBU, primary color sub fields are mainly concentrated on a dominated color field (D-field), as shown in FIG. 3. Through rearranging the color fields, an intensity of the primary colors is enhanced, and clearly-distinguished primary color fields are concentrated into a single mixed color field. Therefore, as compared with the conventional three primary color fields, the present invention achieves the advantages of less CBUs and smaller visibility of the CBU.

Figure 4:
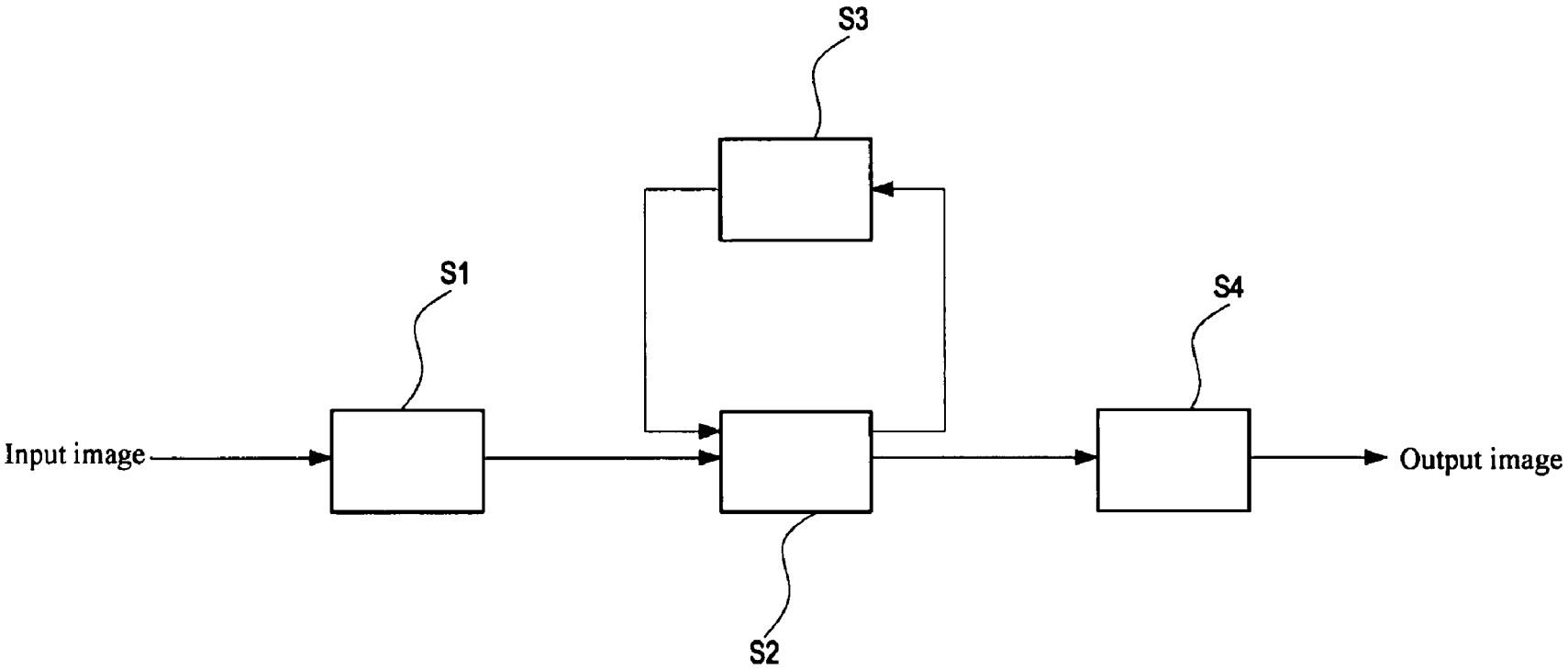
FIG. 4 is a block diagram of a feedback control method according to the present invention.

FIG. 4 is a block diagram of a feedback control method according to the present invention. In order to achieve the above efficacies, the present invention provides feedback determination operational rules for determining the D-field colors and the liquid crystal/backlight signals, so as to meet the requirements of the actual applications. The present invention includes a sampling step S1, a rearrangement step S2, a feedback control step S3, and a liquid crystal/backlight synchronization step S4, which can effectively achieve an optimal backlight value, thereby reducing the influences caused by the CBU.

Sampling Step (S1)

The operational complexity is determined by a resolution of an input image, so that the selected sampling intervals must be compared with each other, and in the sampling ranges from 1×2 to 4×8 pixels, the comparison of the sampling intervals can reduce the calculations and does not influence the image resolution.

Figure 5:
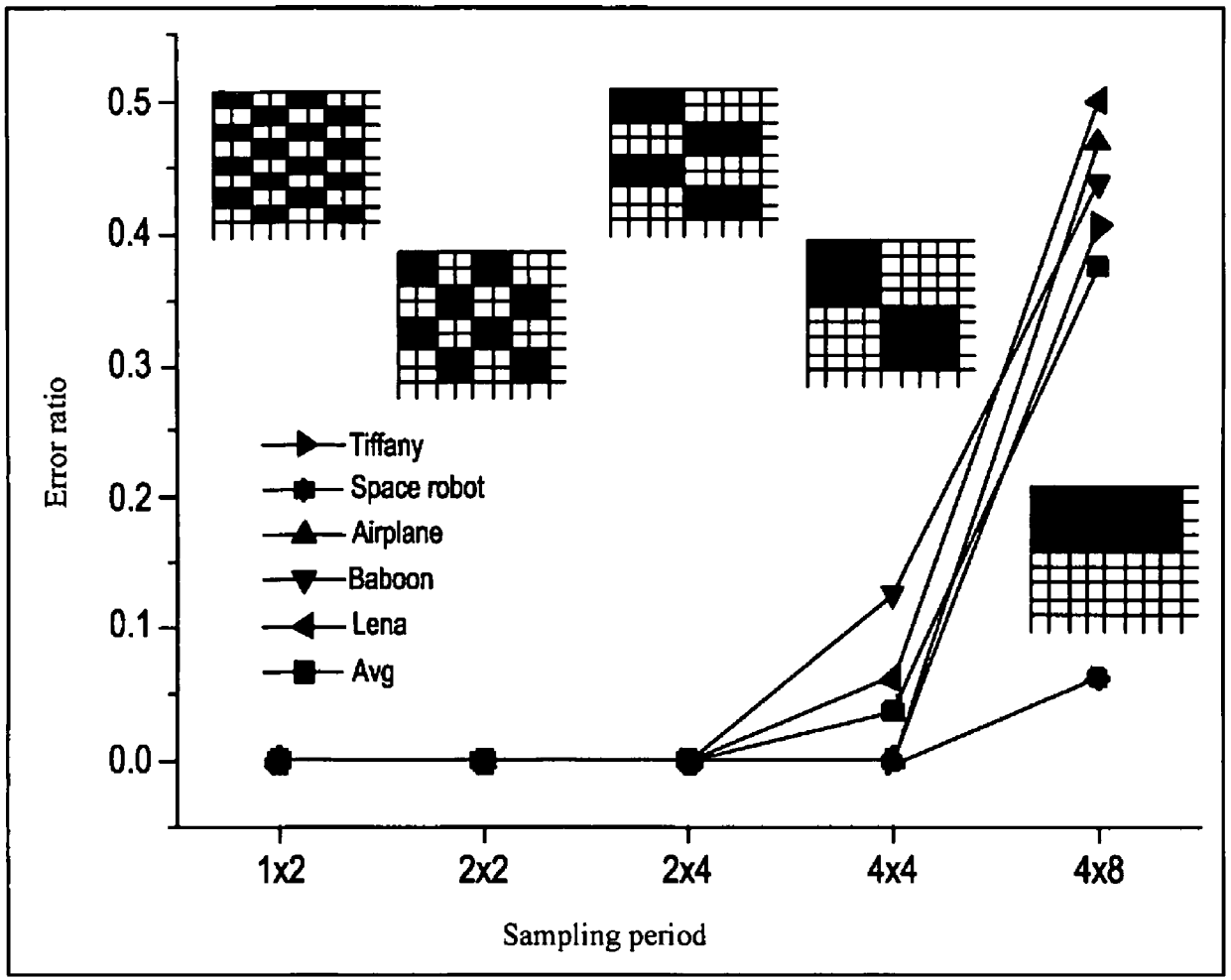
FIG. 5 is a relation diagram generated by comparing an error ratio with a sampling interval of an image.

FIG. 5 is a relation diagram generated by comparing an error ratio with a sampling interval of an image. Referring to FIG. 5, the 2×2 sampling interval is four sub-images with ¼ resolution, and so forth. If such four sub-images are processed through the sum operation to replace the original image, four different backlight statuses can be used together, thereby shortening the step of approaching the minimum $\Delta E_{sum}$. When the minimum $\Delta E_{sum}$ of the sub-image and that of the original image under the three primary color (RGB) backlight status are not equal to each other, such sub-image is considered as an error.

In order to reduce the calculations of the $\Delta E_{sum}$ operation in the subsequent feedback control step (S3) in the actual applications, the optimization of the color backlights on the D-field must be simplified. The image comparison in FIG. 5 is achieved through utilizing five images, namely, Tiffany, Space Robot, Airplane, Baboon, and Lena (not shown) used in FIG. 6 to perform a comparison between the sub-image and the error ratio respectively.

The error ratio is defined as a ratio to the number of errors of all sub-images. As seen from the figure, no error occurs in the sampling interval lower than 2×4 pixels in the five images. Therefore, the 2×4 sampling interval is selected through determining the minimum $\Delta E_{sum}$, so as to provide 8 groups of three primary color (RGB) back lights at the same time.

Rearrangement Step (S2)

The rearrangement of the DRGB color sequential liquid crystal/backlight grayscales is determined by an image content. In the D-field, the gray-scale values of the three primary color backlight are respectively represented as BLr, BLg, and BLb. The relation (Curve γ) between the gray-scale values and the light intensity is a linear relation. According to the backlight information, the new liquid crystal gray-scale values r', g', b', and d respectively formed in the three primary color fields, namely, red (r), green (g), and blue (b) and the D-field (d) are represented in the following equations.

$$r' = T^{-1}(T(r) - T(d) \times BL_r); \quad \text{Equation (1)}$$

$$g' = T^{-1}(T(g) - T(d) \times BL_g); \quad \text{Equation (2)}$$

$$b' = T^{-1}(T(b) - T(d) \times BL_b); \quad \text{Equation (3)}$$

and $$d = T^{-1}\left(\min\left(\frac{T(r)}{BL_r}, \frac{T(g)}{BL_g}, \frac{T(b)}{BL_b}, 1\right)\right); \quad \text{Equation (4)}$$

in which, T(i) represents a transfer function from a gray-scale value i to a transmittance of LC, and $T^{-1}$ represents an inverse function thereof. The Curve γ between the gray-scale value and the transmittance lower than 1 aims to maintain a white balance.

Feedback Control Step (S3)

Figure 7C:
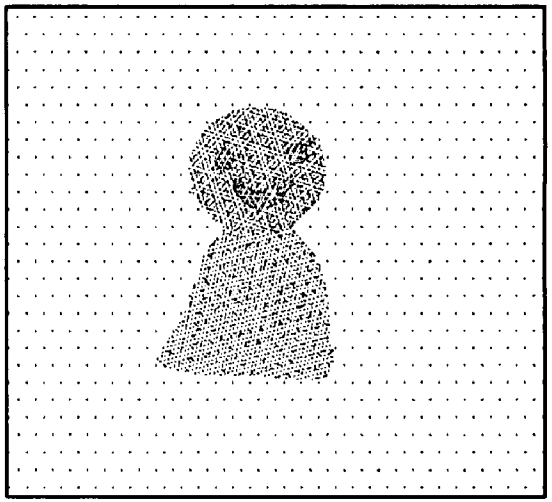
FIG. 7(*a*) shows a CBU image when a conventional D-field has a zero-RGB value (a KRGB color field).
Figure 7B:
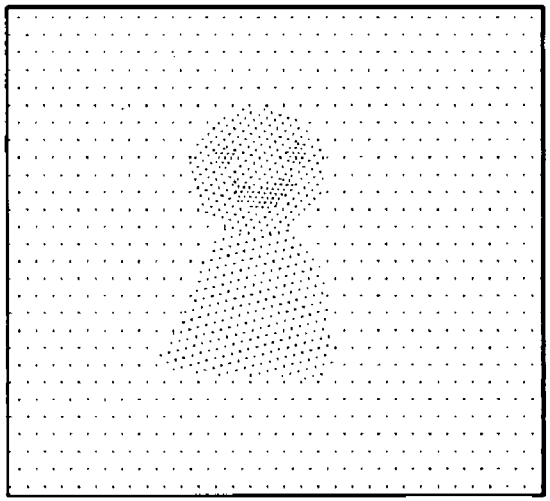
Figure 7A:
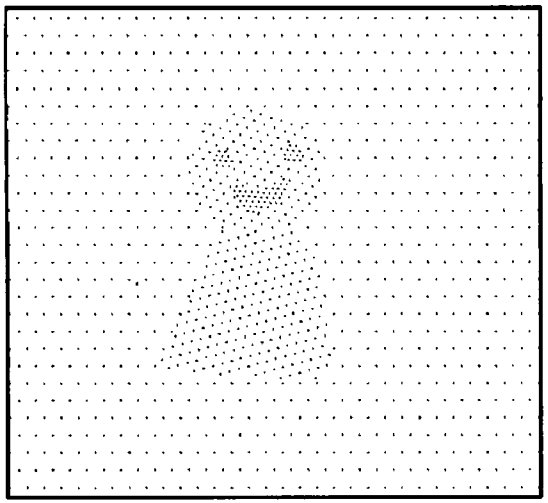

The determination of the color backlights of the D-field is very important for reducing the CBU. Referring to FIG. 7, it shows simulated CBU images of a test image under three different backlight grayscale statuses of the D-field. The simulated CBU image may be formed by four different translated color images. The software adopted for simulation is MATLAB. FIG. 7(*a*) shows a CBU image when the conventional D-field has a zero-RGB value (briefly referred to as a KRGB color field). In other words, such an image is obtained upon being driven by a conventional three primary color field. On the contrary, FIG. 7(*b*) shows an image generated in a white display mode when a conventional D-field provides the highest RGB value (a WRGB color field).

As shown in FIG. 7(*c*), it shows an image generated when the color difference between the CBU and the original image are summed up in the D-field (briefly referred to as a DRGB color field), in which they are summed up through an operation of pixel by pixel sum for separated colors, and the color difference sum $\Delta E_{sum}$ is represented as follows:

$$\Delta E_{sum} = \sum_{total-pixel} \sqrt{(L_{CBU} - L_0)^2 + (u'_{CBU} - u'_0)^2 + (v'_{CBU} - v'_o)^2}; \quad \text{Equation (5)}$$

in which, $Lu'v'_{CBU}$ and $Lu'v'_0$ respectively represent a CBU color value and a color value of an original image in a Lu'v' color space. The color backlights are determined by a brightness distribution of an image in the color field. When the brightness is mainly focused on the D-field, the colors of the three primary color field disappear, and thus, less CBUs are generated. It can be found that, among three images shown in FIG. 7, the CBU phenomenon of the image generated by the $\Delta E_{sum}$ in the DRGB color field is less than that of the images generated by the other two color fields (KRGB and WRGB), and thus the CBU phenomenon is reduced.

Figure 6:
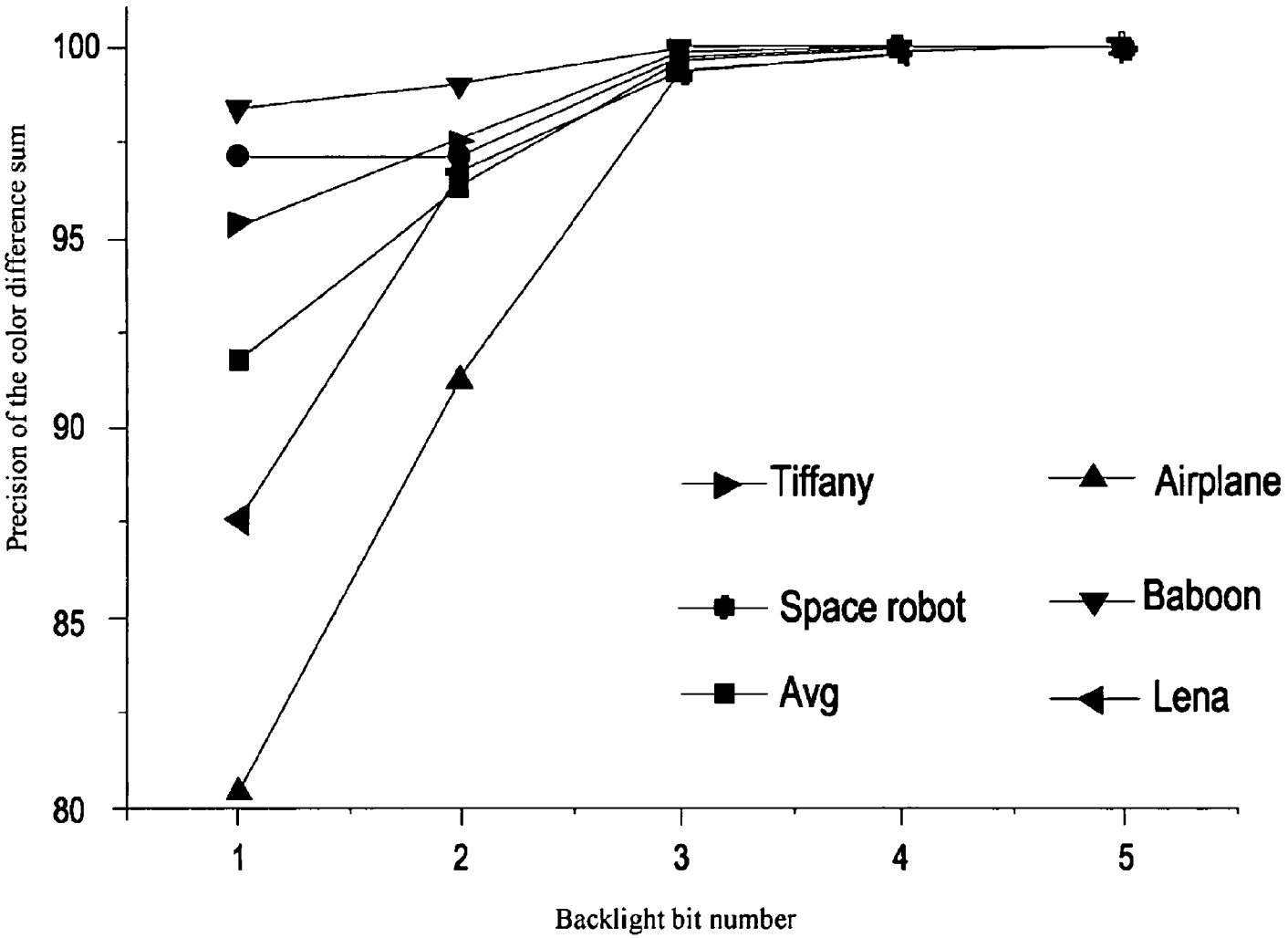
FIG. 6 is a relation diagram between a backlight bit number and a precision of a color difference sum $\Delta_{sum}$ for five test images.

In the actual applications of calculating the $\Delta E_{sum}$, the optimization for the gray-scale values of the color backlights on the D-field must be simplified. The more bits the backlight has, the more precise the minimum $\Delta E_{sum}$ is included, as shown in FIG. 6. However, as the precisions of the backlights are increased, the calculation loads is also increased at an exponential rate. FIG. 6 shows a relation diagram of backlight bits and the precision of the color difference sum $\Delta E_{sum}$ for five test images. As compared with a precision at 1 bit, when the number of bits is larger than 3, it indicates that $\Delta E_{sum}$ of the five test images is saturated. Thus, the precision at 3 bits is set as a modified factor of the RGB backlights, that is, the feedback control is performed with the backlights at 3 bits, thereby achieving the optimal precision and reducing the calculations.

After the above three steps have been performed, that is, through the rearrangement step S2 of calculating the $\Delta E_{sum}$ the sampling step S1 of sampling in the 2×4 sampling interval, and the feedback control step S3 performed with the precision at 3 bits, the minimum $\Delta E_{sum}$ is obtained, and finally, a liquid crystal/backlight synchronization step S4 of determining the backlights is performed. In the synchronization step, a buffer is used for the time delay, so as to achieve a synchronization effect between an LC signal and a backlight signal. Therefore, when the color backlights generated through a manner of the D-field are optimized, the CBU phenomenon is effectively reduced. What's more, the influences caused by the CBU are determined by the sum value.

Figure 8A:
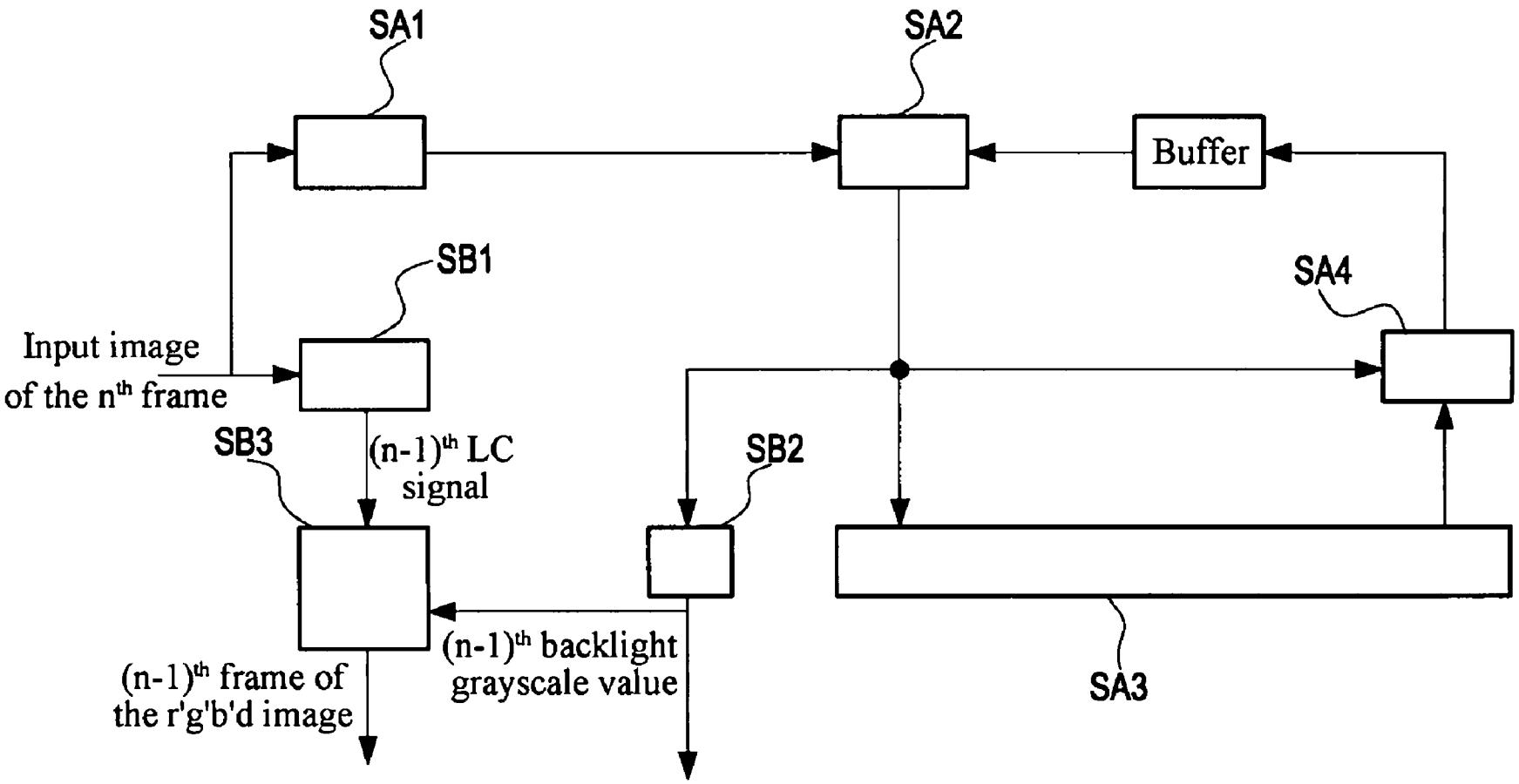
FIG. 8(*a*) is a detailed flow chart for determining a gray-scale value of a liquid crystal and that of color backlights.
Figure 8B:
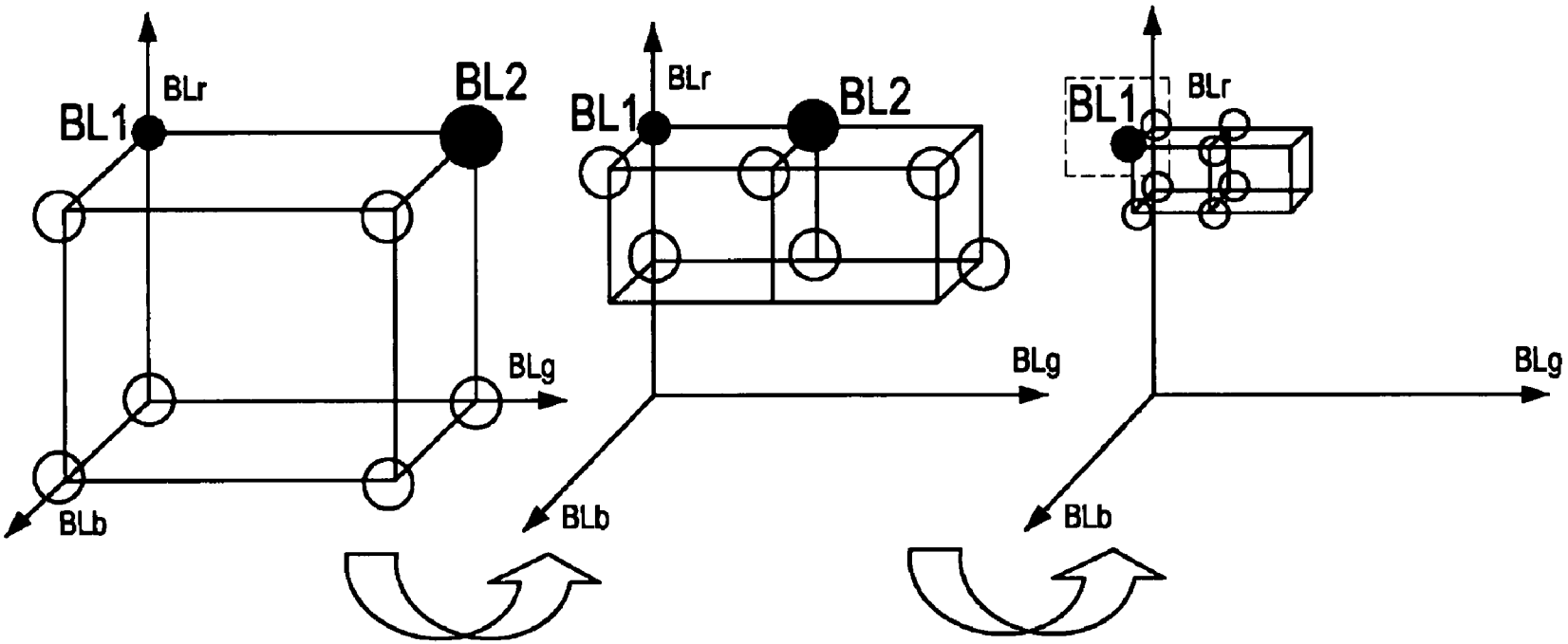

FIGS. 8(*a*) and 8(*b*) are respectively a detailed flow chart for determining a grayscale value of the liquid crystal and that of the color backlights and a schematic view of ultimate backlight values obtained through an approximation with a precision at 3 bits. This embodiment includes a color difference sum acquisition step and a signal synchronization step, which are described below in detail through a specific embodiment.

The color difference sum acquisition step includes the following steps.

In Step SA1, an image in the nth frame is converted into a Lu'v' color space.

In Step SA2, a sampling is performed on 8 sets of 1-bit backlight number and sub-images in a 2×4 sampling interval, and a synchronization 8CBU×$\Delta E_{sum}$ ($\Delta E_{sum}$ of 8 sets of CBUs) is performed on the CBU image through comparing with the original input image.

In Step SA3, $\Delta E_{sum}$ are filtered and the bit numbers for the next frame is determined.

In Step SA4, Consider to be the minimum $\Delta E_{sum}$ of new 7 sets of 2-bit groups from each two adjacent 1-bit groups of color backlight having minimum $\Delta E_{sum}$ respectively.

The filtering condition N in Step SA3 is listed as follows:

$$N(n+1)=\begin{cases} 2, & \text{when } n=1 \\ \min(N(n)+1,3), & \text{if } (\Delta E^{i}_{sum})_n \le (\Delta E^{1}_{sum})_{n-1},\ 1\le i\le 8; \\ \max(N(n)-1,1), & \text{if } (\Delta E^{i}_{sum})_n > (\Delta E^{1}_{sum})_{n-1} \end{cases}$$

In Step SA4, all the 8 groups of color backlights are all processed through a backlight buffer (BL buffer), so as to be used in Step SA2. The buffer is a signal register used for performing synchronization between an LC signal and a backlight signal.

The other part shown in FIG. 8(*a*) is a signal synchronization step, i.e., performing synchronization between an LC signal and a backlight signal, which is described below.

In Step SB1, an LC signal of an input image is processed through a frame buffer, so as to obtain a LC signal of a $(n-1)^{th}$ frame.

In Step SB2, a minimum CBU−$\Delta E_{sum}$ of a color backlight is processed through a BL buffer, so as to obtain a backlight gray-scale value of the $(n-1)^{th}$ frame.

In Step SB3, a lookup table (LUT) is used to generate a new LC gray-scale value through using the synchronized LC signal and backlight gray-scale value of the $(n-1)^{th}$ frame.

As shown in FIG. 8(*b*), solid dots in the 1-bit group and the 2-bit group indicate two groups with minimum $\Delta E_{sum}$ (BL1 and BL2), whereas hollow dots indicate the other groups with larger $\Delta E_{sum}$. If the sum of any 2-bit group equals to or is smaller than that of the 1-bit group, an approximation operation is performed at 3 bits in the 3-bit group, that is, performed in the Step SA3. On the contrary, if the $\Delta E_{sum}$ of all the 2-bit groups is larger than that of the 1-bit group, 8 groups of 1-bit color backlights are used to perform the CBU−$\Delta E_{sum}$ calculation in the next frame. The bit precision of the color backlights is controlled by a feedback used for determining the backlight optimization.

Therefore, the above feedback control method can reduce the CBU phenomenon, such that the generated CBUs are minimized or controlled to reduce the calculation loads.

The invention claimed is:

1. An adaptive feedback control method of a field sequential color (FSC) display, comprising:

a rearrangement step, wherein gray-scale values of a three primary color field of an input image are converted into gray-scale values of a new three primary color field and a dominated color field (D-field);

a sampling step, wherein a pixel sampling is performed on a resolution of the input image in a sampling interval;

a feedback control step, wherein a pixel by pixel sum operation is performed for each separated color on a color break-up (CBU) color value and a color value of the input image in a Lu'v' color space to obtain a color difference sum, and a feedback control is performed at a bit precision on the color difference sum, thereby obtaining a minimum color difference sum; and a liquid crystal/backlight synchronization step, wherein a liquid crystal signal (LC signal) and a backlight gray-scale value of the input image are synchronized according to the minimum color difference sum;

wherein the color difference sum $\Delta E_{sum}$ is represented in the following equation:

$$\Delta E_{sum}=\sum_{total-pixel}\sqrt{(L_{CBU}-L_0)^2+(u'_{CBU}-u'_0)^2+(v'_{CBU}-v'_o)^2};$$

$Lu'v'_{CBU}$ and $Lu'v'_0$ respectively represent the CBU color value and the color value of the input image in the Lu'v' color space.

2. The adaptive feedback control method according to claim 1, wherein the sampling interval is a 2×4 pixel by pixel interval.

3. The adaptive feedback control method according to claim 2, wherein the interval generates 8 groups of CBU color difference sums (CBU−$\Delta E_{sum}$).

4. The adaptive feedback control method according to claim 1, wherein the bit precision is a 3-bit precision.

5. The adaptive feedback control method according to claim 1, wherein new gray-scale values r', g', b', and d in the rearrangement step are represented in the following equations:

$$r'=T^{-1}(T(r)-T(d)\times BL_r);$$

$$g'=T^{-1}(T(g)-T(d)\times BL_g);$$

$$b'=T^{-1}(T(b)-T(d)\times BL_b);$$

and $$d=T^{-1}\left(\min\left(\frac{T(r)}{BL_r},\frac{T(g)}{BL_g},\frac{T(b)}{BL_b},1\right)\right);$$

the gray-scale values of three primary color field are respectively represented as $BL_r$, $BL_g$, and $BL_b$, T(i) represents a transfer function from a grayscale value i to a transmittance of liquid crystal (LC), and $T^{-1}$ is an inverse function thereof.

6. An adaptive feedback control method of a field sequential color (FSC) display, comprising a color difference sum acquisition step and a signal synchronization step, wherein:

the color difference sum acquisition step comprises:

converting an image of a $n^{th}$ frame into a L'v' color space;

sampling on 8 groups of 1-bit backlights and sub-images in a 2×4 sampling interval to include a CBU image, and performing 8 groups of color break-up (CBU) color difference sum operations synchronously through comparing with an input image;

filtering the color difference sums and determining a bit number of a next frame; and considering to be the minimum color difference sum of new 7 sets of 2-bit groups from each two adjacent 1-bit groups of color backlight having minimum a color difference sum respectively; and the signal synchronization step comprises:

processing a liquid crystal signal (LC signal) of the input image by a frame buffer, so as to obtain a LC signal of a $(n-1)^{th}$ frame;

processing a minimum CBU color difference sum of a color backlight by a backlight buffer (BL buffer), so as to obtain a backlight gray-scale value of the $(n-1)^{th}$ frame; and using a lookup table (LUT) to generate a new LC gray-scale value through using the synchronized LC signal and backlight gray-scale value of the $(n-1)^{th}$ frame;

wherein the color difference sum $\Delta E_{sum}$ is represented in the following equation:

$$\Delta E_{sum} = \sum_{total-pixel} \sqrt{(L_{CBU} - L_0)^2 + (u'_{CBU} - u'_0)^2 + (v'_{CBU} - v'_o)^2};$$

$Lu'v'_{CBU}$ and $Lu'v'_0$ respectively represent the CBU color value and the color value of the input image in the Lu'v' color space.

7. The adaptive feedback control method according to claim 6, wherein a filtering condition N for the color difference sums is listed as follows:

$$N(n+1) = \begin{cases} 2, & \text{when } n = 1 \\ \min(N(n)+1, 3), & \text{if } (\Delta E^i_{sum})_n \le (\Delta E^1_{sum})_{n-1}, \text{ and } 1 \le i \le 8. \\ \max(N(n)-1, 1), & \text{if } (\Delta E^i_{sum})_n > (\Delta E^1_{sum})_{n-1} \end{cases}$$

($\Delta E^1$sum) are 8 groups of color break-up (CBU) color difference sum, and ($\Delta E^1$sum) is the first group of color break-up (CBU) color difference sum.

8. The adaptive feedback control method according to claim 6, wherein in the step of consider to be the minimum color difference sum of new 7 sets of 2-bit groups from each two adjacent 1-bit groups of color backlight having minimum a color difference sum respectively, all 8 groups of color backlights are processed by a BL buffer and then used in the step of performing a CBU color difference sum operation of 8 groups synchronously, and the buffer is a signal register used for performing synchronization between the LC signal and the backlight gray-scale value.

* * * * *